United States Patent [19]

Brakensiek

[11] 3,938,838

[45] Feb. 17, 1976

[54] SLIDING DOOR LOCK

[76] Inventor: Lee Wesley Brakensiek, 10508 Rancho Road, La Mesa, Calif. 92041

[22] Filed: July 15, 1974

[21] Appl. No.: 488,706

[52] U.S. Cl. ..... 292/210; 292/238; 292/DIG. 9

[51] Int. Cl.[2] ..... E05C 3/04

[58] Field of Search 292/210, 238, 256.69, DIG. 46, 292/DIG. 9, DIG. 17; 16/28

[56] References Cited

UNITED STATES PATENTS

| | | | |
|---|---|---|---|
| 307,545 | 11/1884 | Hart | 292/210 |
| 983,647 | 2/1911 | Romines | 292/DIG. 46 |
| 1,223,389 | 4/1917 | Hynes | 292/DIG. 46 |
| 1,589,149 | 6/1926 | Hanle | 292/210 |
| 1,870,332 | 8/1932 | Jokubaitis | 292/238 |
| 1,950,251 | 3/1934 | Kulefsky | 292/DIG. 9 |
| 2,612,398 | 9/1952 | Miller | 292/238 |
| 2,792,246 | 5/1957 | Sisson | 292/DIG. 46 |
| 2,905,496 | 9/1959 | Hornsby | 292/256.69 |
| 3,837,693 | 9/1974 | Adickes | 292/DIG. 9 |

FOREIGN PATENTS OR APPLICATIONS

| | | | |
|---|---|---|---|
| 9,135 | 8/1927 | Australia | 292/238 |

*Primary Examiner*—Paul R. Gilliam
*Assistant Examiner*—Victor N. Sakran
*Attorney, Agent, or Firm*—Frank D. Gilliam

[57] ABSTRACT

A lock for a sliding door comprising a base member fixedly secured to an outer surface of a sliding door guide channel with a leaf member pivotly connected to the base member. The leaf member is pivotable from a position where it is substantially an extention of the base member and the door is freely slidable to a second position substantially perpendicular to the base member and the door is obstructed from movement from a closed to an open position. A translatable locking means carried by the base members is provided to prevent the leaf member from movement from its second position to its first position. An additional stop member is provided for attachment to the door when the door is positioned remote from its outer channel member for engagement with the leaf member when the leaf member is in its second position.

2 Claims, 4 Drawing Figures

SLIDING DOOR LOCK

BACKGROUND OF THE INVENTION

The present invention relates to an improved door lock and more specifically to a lock means for preventing the opening of a slidable door.

Presently available locking means for this specific purpose are quite complicated in that they utilize a plurality of moving parts thus making them expensive and susceptible to failure. Most require a key for operation. The key is often misplaced or is inconvienent to use because of physical placement of the lock. Other less expensive and complicated locking means have proven inadequate in that the door is still free to be moved vertically and can be pryed upward and rearward in a semi-rotational movement allowing easy removal of the entire door panel for entry.

The solution to these problems had not been successfully resolved until the emergence of the instant invention.

SUMMARY OF THE INVENTION

In accordance with the instant invention there is provided a new and novel inexpensive locking device for slidable doors having simplicity of operation, using but a minimum of movable parts, requires no key and prevents rotational movement of the door when the lock is operative thereby preventing unwanted door removal.

Other features and advantages of this novel invention will become apparent from the following description taken in connection with the accompanying drawings wherein are set forth, by way of illustration and examination, certain embodiments of the invention.

DETAILED DESCRIPTION OF ONE EMBODIMENT

Figure 1:
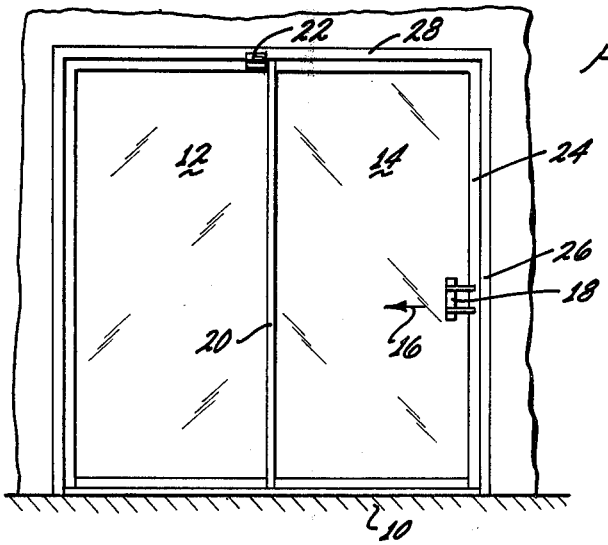
FIG. 1 shows the locking device of the invention mounted to a slidable door.

Referring now to FIG. 1, a conventional dwelling patio door 10 is shown. One panel 12 is fixed in place and immovable. Door panel 14 is movable in the direction of arrow 16 by manual operation of handle 18. The door panel 14 is shown in a closed position with its back upright 20 positioned slightly forward of lock member 22. The forward upright 24 of door panel 14 is against door casing channel member 26. The lock member 22 is shown secured to upper door casing channel member 28.

Figure 3:
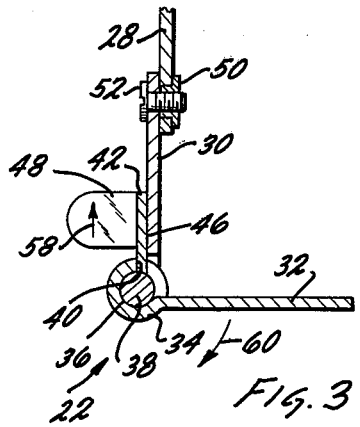
FIG. 3 is a sectional view of FIG. 2 taken along line 3—3.
Figure 2:
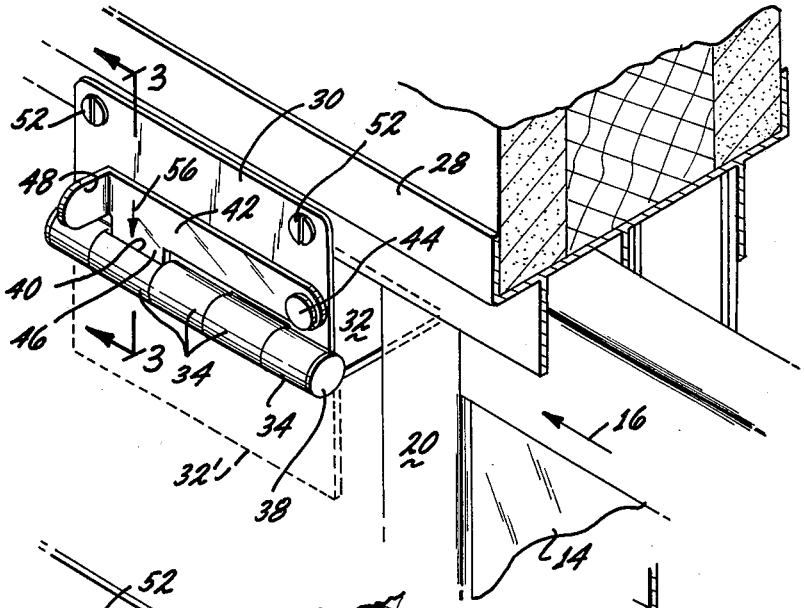
FIG. 2 is a sectional perspective view of a portion of FIG. 1.

Referring now to FIGS. 2 and 3, the locking means 22 includes a base plate 30 and a leaf member 32. Both base plate 30 and leaf member 32 include bearing means 34 attached thereto. The bearing means 34 have a common bore 36 therethrough and are inter meshing as shown resembling a conventional leaf hinge. A hinge pin 38 passes through the bores 36 of bearing means 34 to secure the base plate 30 and leaf member 32 together and to additionally provide for relative pivotable movement between the members 30, 32. It should be understood that the number of bearing members 34 shown and the configuration of the base plate 30 and leaf member 32 are descriptive only and not limiting. Obviously any convenient shape for members 30 and 32 or various numbers of bearing means 34 on the members could be utilized to successfully practice the invention.

One of the bearing means 34 carried by the leaf member 32 is provided with a cutaway portion 40 extending from its outer surface to its bore 36.

A locking lever 42 is carried by the base plate 30. The locking lever 42 is shown pivotly connected to the base plate 30 by a keeper 44. The keeper 44, shown as a rivet passing through the base plate 30 with enlarged heads (one not shown), is for securing therein. Obviously any convenient attachment could be used for this purpose. The opposite end of the locking lever 42 has a downward extending tab 46 and an outward extending actuating portion 48.

Aperatures through the upper base plate 30 are provided to secure the locking means 22 to upper door casing channel 28. The base plate 30 must be secured to the channel 28 in a manner so that the attachment means does not interfer with the free sliding movement of the door panel 14. The attachment means shown includes a bushing 50 having a portion passing through an aperture in the upper channel 28 and base plate 30. The bushing 50 is shown with an enlarged head of narrow cross sectional width, this feature prevents the inter bushing from passing through the aperatures. The inner portion of the bushing 50 (not shown) includes threads. A threaded bolt 52 having a length slightly less than the combined cross-sectional width of the base plate and bushing is tightly screwed into the bushing 50.

The phantom positional showing 32' of the leaf member 32 (in FIG. 2) is the first inoperative position of the locking apparatus. In this position door panel 14 is free to move in the direction of arrow 16 without interference from the leaf 32 of lock member 22.

In the second operative position shown for leaf member 32, perpendicular to the base plate 30, is the lock position wherein the leaf is directly adjacent and behind upright of door panel 14 preventing movement of the door panel in the direction of arrow 16.

Figure 4:
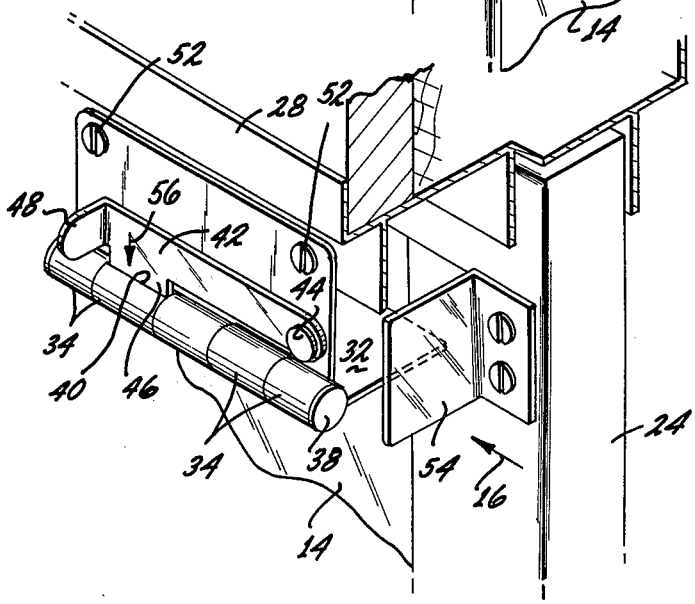
FIG. 4 is a sectional perspective view of FIG. 1 showing a second embodiment of the invention.

In the showing of FIG. 4, the description of the lock member 22 is as hereinbefore described. As can be readily seen, the door panel 14 of FIG. 4 is positioned in a guide channel remote from lock member 22 with the rear upright 20 of door panel 14 positioned behind the forward upright portion of door panel 12 (not shown) thus making the upright 20 of door panel 14 inaccessible for locking as hereinbefore described. When the sliding panel 14 is in this position an addition stop member 54 is secured to the top portion of forward upright 24 to engage leaf member 32 of the lock member 22 when in the perpendicular position shown in FIGS. 2, 3 and 4.

The stop member 54 can be secured to the door panel by any convenient attachment means common sheet metal screws being shown.

OPERATION

The operation of the lock member 22 is obviously very basic. As hereinbefore described, when the leaf member 32 is in its downward free hanging position, as the phantom showing in FIG. 2, the door panel 14 is free to slide in a direction of arrow 16.

When it is desired to secure the door panel from movement the door is first closed, as shown in FIG. 1, then leaf member 32 is pivoted into its perpendicular position as shown in FIG. 2, 3, and 4 and the locking lever 42 is then moved in the direction of arrow 56 of FIGS. 2 and 4 wherein the extending tab 46 fits within cutaway portion 40 thereby preventing the leaf member 32 from returning to the FIG. 2 phantom free hanging inoperative position. The door panel 14 now cannot now be moved from its FIG. 1 closed position.

When it is desirable to again provide free movement of the door panel the locking bar 48 is moved upward, as shown by arrow 58 of FIG. 3, wherein gravity returns the leaf member 32 in the direction of arrow 60 to its free hanging position shown in phantom in FIG. 2.

Since obvious changes may be made in the specific embodiments of the invention described herein, it is indicated that all matter contained herein is intended as illustrative and not limiting in scope.

Having thus described the invention, what is claimed as new and desire to be secured by Letters Patent of the United States is:

1. An improved locking apparatus for a slidable door panel, said panel slidable within upper and lower channels of a door casing comprising:

a base member fixedly attached to the outer surface of said upper channel parallel to and remote from said slidable door panel;

a leaf member having a hinged attachment to said base member of movement from a first position where said leaf member hangs downward by the force of gravity and is substantially an extension of said base member to a second position inwardly toward said slidable door panel where said leaf member is substantially perpendicular to said base member, a section of the hinge of said leaf member having a cutaway portion, one edge of said cutaway portion being positioned adjacent said base member when said base member is in said second position; and a locking lever positioned parallel to the surface of said base member and pivotable about its end attachment thereto, said locking lever having a downward extending tab portion on its end remote from its attachment end for abutting said one edge of said cutaway portion and holding said leaf member in said second position and an outward extending actuating member adjacent said tab for actuation of said locking lever.

2. The invention of claim 1 wherein said locking apparatus additionally comprises a stop bracket attached to said slidable door for abutment with said leaf member when said leaf member is in said second position.

* * * * *